US007318548B2

(12) United States Patent
Felice et al.

(10) Patent No.: US 7,318,548 B2
(45) Date of Patent: Jan. 15, 2008

(54) APPARATUS AND METHOD FOR ISOLATING DEPOSITED ITEMS

(75) Inventors: Robert J. Felice, Endicott, NY (US); Patrick J. Fitzgibbons, Owego, NY (US); John T. Swider, Port Crane, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 423 days.

(21) Appl. No.: 10/397,920

(22) Filed: Mar. 26, 2003

(65) Prior Publication Data

US 2003/0209595 A1 Nov. 13, 2003

Related U.S. Application Data

(60) Provisional application No. 60/400,466, filed on Aug. 1, 2002, provisional application No. 60/367,691, filed on Mar. 26, 2002.

(51) Int. Cl.
*B65G 11/04* (2006.01)

(52) U.S. Cl. ..... 232/45; 232/19; 232/30; 383/33

(58) Field of Classification Search ..... 232/30–32, 232/45, 19, 43.2, 1 E; 109/66–68; 220/476, 220/478; 193/33, 34, 8; 383/75, 76, 33
See application file for complete search history.

(56) References Cited

U.S. PATENT DOCUMENTS

| | | | | | |
|---|---|---|---|---|---|
| 166,800 | A | * | 8/1875 | Newcomer | 232/19 |
| 329,293 | A | | 10/1885 | Ehrlich | |
| 336,052 | A | * | 2/1886 | Jovine | 232/32 |
| 400,026 | A | * | 3/1889 | Wicek | 232/32 |
| 518,574 | A | * | 4/1894 | Procter | 383/34 |
| 934,245 | A | * | 9/1909 | Viezzi | 232/32 |
| 1,451,343 | A | | 4/1923 | Panagopolous | |
| 1,797,961 | A | * | 3/1931 | McBride | 383/33 |
| 2,186,384 | A | * | 1/1940 | Lester | 383/72 |
| 3,211,367 | A | * | 10/1965 | Daunt | 232/43.2 |
| 3,261,441 | A | * | 7/1966 | Mullens | 193/33 |
| 3,263,854 | A | * | 8/1966 | Powers | 232/43.5 |
| 3,554,345 | A | * | 1/1971 | Mullens | 193/33 |
| 3,802,620 | A | * | 4/1974 | Ferrara | 232/19 |
| 3,854,656 | A | | 12/1974 | Bishop et al. | |
| 4,069,965 | A | * | 1/1978 | Maddox, Jr. | 232/19 |
| 4,670,227 | A | | 6/1987 | Smith | |
| 4,776,512 | A | * | 10/1988 | Moore et al. | 232/19 |

(Continued)

OTHER PUBLICATIONS

U.S. Provisional Patent Appl. No. 60/367,691, filed Mar. 26, 2002. Title: Lobby collection mail containment system. Applicants: Robert J. Felice et al.

(Continued)

*Primary Examiner*—William L. Miller
(74) *Attorney, Agent, or Firm*—Burns & Levinson LLP; Jacob N. Erlich; David W. Gomes

(57) ABSTRACT

A mail depository apparatus includes a rigid housing forming a channel adapted for directing deposited mail items and an interface member adapted to attach a flexible container to the housing for receiving deposited mail items from the channel, wherein the interface member is adapted to seal the flexible container to the housing to substantially prevent escape of air from the flexible container and the housing at the interface member.

25 Claims, 6 Drawing Sheets

U.S. PATENT DOCUMENTS 4,802,773 A * 2/1989 Gross ..... 383/16
4,815,640 A * 3/1989 Johnson ..... 224/601
4,826,075 A * 5/1989 Burns ..... 232/19
4,867,576 A * 9/1989 Boyd ..... 383/33
5,007,581 A * 4/1991 Douglas ..... 232/43.2
5,020,651 A 6/1991 Lockett
5,346,311 A * 9/1994 Siler et al. ..... 383/75
5,368,226 A * 11/1994 Franceschino ..... 232/19
5,447,699 A 9/1995 Papciak et al.
5,492,272 A * 2/1996 Fewer ..... 232/19
5,645,353 A * 7/1997 Linnell et al. ..... 383/22
6,003,717 A * 12/1999 Long ..... 220/495.11
6,138,558 A 10/2000 Harrington
6,378,767 B1 * 4/2002 Steele ..... 232/19
6,494,619 B1 * 12/2002 Sulpizio ..... 383/33
6,742,703 B2 6/2004 Esakov et al. ..... 232/45
2002/0070269 A1 * 6/2002 Rosiello et al. ..... 232/19
2003/0222132 A1 12/2003 Esakov et al. ..... 232/30

OTHER PUBLICATIONS

U.S. Provisional Patent Appl. No. 60/400,466, filed Aug. 1, 2002. Title: Mail collection box system and method. Applicants: John T. Swider et al.

U.S. Postal Service Emergency Preparedness Plan for Protecting Postal Employees and Postal Customers from Exposure to Biohazardous Material and for Ensuring Mail Security Against Bioterror Attacks; Mar. 6, 2002; published by USPS.

* cited by examiner

APPARATUS AND METHOD FOR ISOLATING DEPOSITED ITEMS

RELATED APPLICATIONS

The present application claims priority for U.S. Provisional Patent Application Ser. No. 60/367,691, filed Mar. 26, 2002 and entitled LOBBY COLLECTION MAIL CONTAINMENT SYSTEM, and U.S. Provisional Patent Application Ser. No. 60/400,466, filed Aug. 1, 2002 and entitled MAIL COLLECTION BOX SYSTEM AND METHOD.

FIELD OF THE INVENTION

The present invention generally relates to depository boxes, such as mail boxes, and in particular to such mail boxes which isolate items received therein to prevent the spread of contaminants.

BACKGROUND OF THE INVENTION

The recent incidents of anthrax-laced letters being transported through the United States Postal Service (USPS) facilities by unsuspecting mail handlers to unsuspecting recipients has alarmed the nation and the world. Currently, the tainted letters are discovered after the recipient accepts delivery or by alert postal employees noticing white powder that could be anthrax on mail parcels, sorting and distribution equipment, or themselves. There appear to be no current security devices or procedures that are available to intercept such letters at the earliest source of introduction into the USPS system.

Therefore, it would be advantageous to be able to isolate items dropped into mail boxes and other public drop boxes, so that adequate testing may be performed to detect the presence of any contaminants.

SUMMARY OF THE INVENTION

In one form, the present invention provides a mail depository apparatus comprising a rigid housing forming a channel adapted for directing deposited mail items and an interface member adapted to removeably attach a flexible container to the housing for receiving deposited mail items from the channel, wherein the interface member is adapted to seal the flexible container to the housing to substantially prevent escape of air from the flexible container and the housing at the interface member. The housing may include a housing opening forming an exit from the channel, and the interface member may include a peripheral surface adapted for contacting the housing around the housing opening. The interface member may be adapted to pinch a peripheral edge of a flexible container opening between the peripheral surface and the housing around the housing opening.

The interface member may also be adapted to be fixedly mounted to a structure, and the housing may be adapted to be movably mounted to the structure to enable installation of a flexible container between the interface member and the housing by movement of the housing. The interface member may include a rigid ring. The housing may be hinged to the structure along an upper portion of the housing and adapted for upward rotation away from the fixedly mounted interface member. The structure may be a wall and the channel may be adapted for access through an opening in the wall.

The housing may include a closure device located in proximity to the housing opening and adapted to isolate the housing opening from the channel. The housing may further include a vent conduit adapted for directing air flow from a flexible container sealed to the housing and through the housing opening. The vent conduit may be directed away from any personnel engaged in typical closure and removal of the flexible container.

The interface member may include a stiffening ring adapted to engage a peripheral edge of a flexible container opening. The stiffening ring may be sealed to the peripheral edge of the flexible container opening. The interface member may further include a collar adapted to pinch the stiffening ring and an engaged peripheral edge.

The collar may include a plurality of sides each having an inwardly facing channel adapted to receive the stiffening ring. One of the sides may be moveable to allow installation and removal from the collar of the stiffening ring and an associated flexible container. The collar may be adapted to squeeze a periphery of the stiffening ring when the ring is pressed into the collar by the moveable side. The collar may be trapezoidal in shape, and the one moveable side may longer than each of the fixed sides.

The stiffening ring may only be stiff in a dimension perpendicular to an imaginary plane defined by the flexible container opening. The stiffening ring may be an elongated piece of nominally stiff material that is folded in one or more dimensions parallel to the imaginary plane to form a ring. The elongated piece of material may be adapted to enable the stiffening ring to be folded flat.

The apparatus may further include a flexible container having a single opening adapted to be substantially sealed to the housing by the interface member. A cinching strap may be peripherally located around the flexible container in proximity to the single opening and adapted to constrict the flexible container and close the flexible container while the flexible container is sealed to the housing.

In another form, the present invention provides a mail depository apparatus, comprising a mail box forming a central chamber and having a depository port located in proximity to a top of the mail box and an access door located in proximity to a bottom of the mail box, and a divider located within the central chamber and adapted for separating the central chamber into a reception chamber in operable association with the depository port and a storage chamber in operable association with the access door. The divider may include a divider opening adapted to allow items deposited into the depository port to drop into the storage chamber. The apparatus may further include an interface member adapted to attach a flexible container located in the storage chamber, to the divider opening for receiving deposited items from the reception chamber, wherein the interface member is adapted to seal the flexible container to the divider opening to substantially prevent escape of air from the flexible container and the reception chamber at the interface member.

The divider may include a closure device located in proximity to the divider opening and adapted to isolate the divider opening from the reception chamber, and a vent conduit adapted to direct air flow from a flexible container sealed to the divider and through the divider opening, wherein the vent conduit is routed to a remote location away from any personnel engaged in typical closure and removal of the flexible container. The apparatus may further include a filter device coupled to the vent conduit and adapted for filtering air flow directed from the flexible container.

In yet another form, the present invention provides a method for collecting mail items in a flexible container, comprising the steps of orienting a channel for directing deposited mail items to drop through a channel opening; and sealing a flexible container around the channel opening with an interface member to contain mail items and to prevent escape of air from the flexible container and the channel at the interface member.

The method may further include closing the channel opening to isolate the channel from the flexible container. The step of sealing may include pinching a peripheral edge of a flexible container opening between the interface member and a housing forming at least a portion of the channel.

The method may still further include cinching the flexible container substantially closed in proximity to the channel opening while the flexible container is sealed around the channel opening. This method may include exhausting air from the flexible container through a conduit after cinching the flexible container substantially closed. This method may still further include removing the flexible container from the channel opening after the step of cinching the flexible container substantially closed.

In another embodiment of the present invention, a flexible container for receiving deposited mail items includes a flexible bag having an opening sized to fit around a rigid collar and a stiffening ring adapted to engage the flexible bag around the opening and to facilitate sealing the flexible bag to a collar. The flexible bag is adapted to be cinched closed in proximity to the stiffening ring while the flexible bag is fitted to a collar.

The flexible bag may include a plurality of layers forming at least a portion of the bag and a cinch strap may be at least partially enclosed between the plurality of layers. The stiffening ring may be sealed to the opening. The stiffening ring may be adapted to be sealed to a collar. The stiffening ring may be stiff in two orthogonal dimensions parallel to an imaginary plane formed by the opening. Alternately, the ring may be stiff in a dimension perpendicular to an imaginary plane formed by the opening. The container may include an adhesive strip located around the opening to facilitate sealing the opening to a collar.

BRIEF DESCRIPTION OF THE DRAWINGS

The present invention is illustratively shown and described in reference to the accompanying drawings, in which.

DETAILED DESCRIPTION OF THE DRAWINGS

Figures 1, 2, 3:
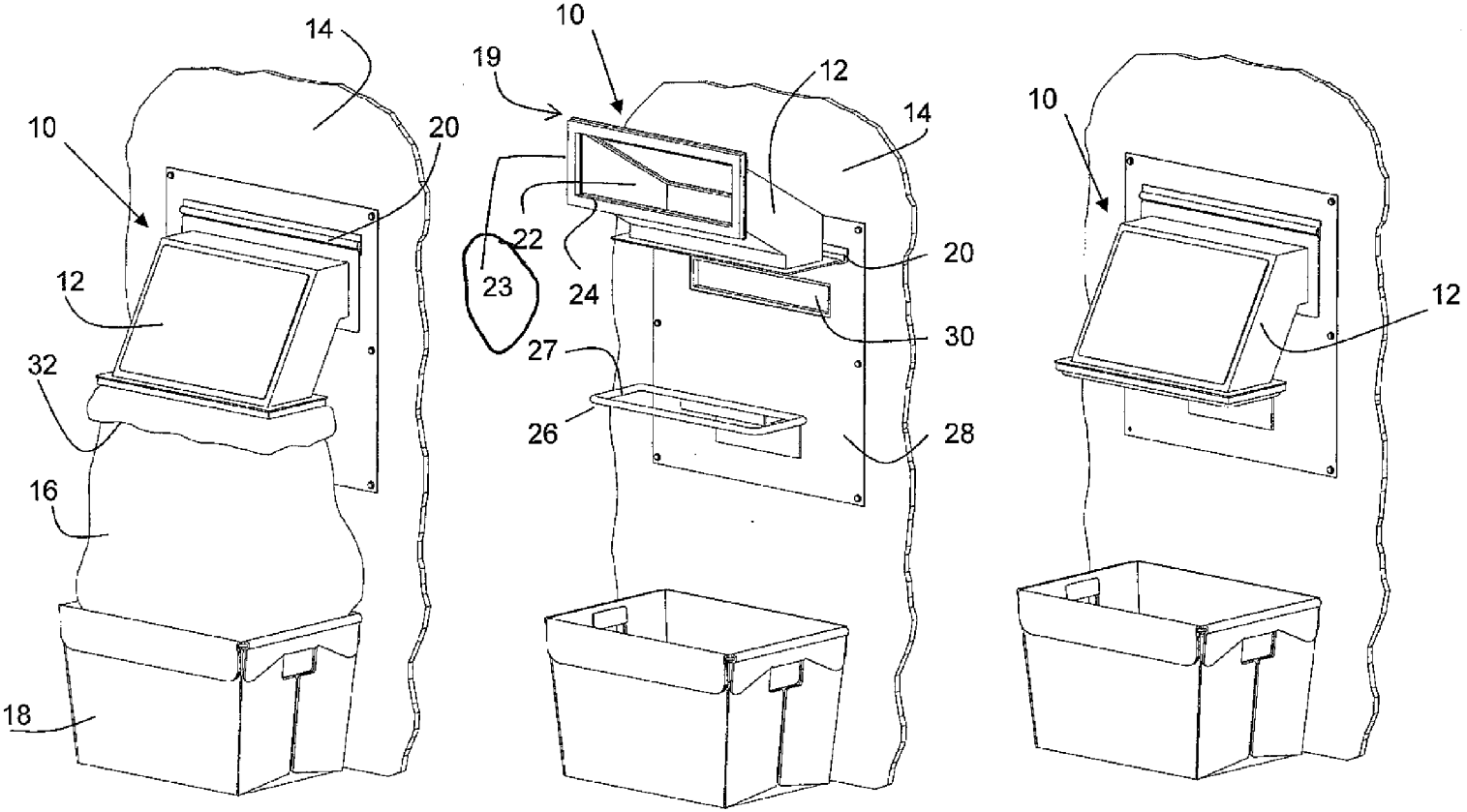
FIG. 1 is a perspective view of a mail depository apparatus constructed in accordance with one embodiment of the present invention.
FIG. 2 is a perspective view of a portion of the apparatus of FIG. 1.
FIG. 3 is a perspective view of the apparatus of FIG. 2 located in a different position.

The present invention is first described in reference to the embodiment of FIGS. 1-3, which generally show a rigid housing 12 mounted to a structural wall 14 and having a flexible container 16 engaged with rigid housing 12 to receive mail items deposited through housing 12. Also shown is a standard mail tub 18, which may be used to partially contain flexible container 16.

FIG. 2 shows the apparatus 10, absent flexible container 16, and with rigid housing 12 rotated to an upper position 19 from FIG. 1. Housing 12 is shown to be rotated upwardly around a hinge 20. Rigid housing 12 is shown to form a reception chamber or channel 22, and has a housing opening 24 forming an exit to channel 22. Housing opening 24 is defined by a portion 23 of housing 12. Also shown in FIG. 2 is interface member 26, which is fixedly mounted to wall 14.

Interface member 26 is generally rectangular in shape to match housing portion 23 and includes a peripheral surface 27 which faces upwardly towards housing 12. To provide for easier mounting of apparatus 10 on wall 14, a mounting plate 28 is shown, to which interface member 26 is fixedly mounted and housing 12 is rotatably mounted at hinge 20. Also shown in mounting plate 28 is a depository opening 30 which passes through wall 14 and aligns with a matching opening (not shown) in housing 12 and channel 22. Mounting plate 28 maintains the proper orientation between rigid housing 12 and interface member 26 and provides easy mounting of the entire apparatus 10 to wall 14.

FIG. 3 is a perspective view of apparatus 10, wherein rigid housing 12 is located in the lowered position abutting the upper surface 27 of interface member 26 (FIG. 2) around housing opening 24 (FIG. 2). Housing portion 23 (FIG. 2) is adapted to abut peripheral surface 27 of interface member 26 and to be partially supported thereby.

In operation, housing 12 is raised to the upper position 19 (FIG. 2) while the peripheral edge 32 of a flexible container 16, such as a plastic bag, is passed through the central opening 25 of interface member 26 and then folded back on the container 16, over peripheral surface 27 and around interface member 26 as shown. Housing 12 is then lowered to pinch the opening of flexible bag 16 between peripheral surface 27 and housing portion 23 around opening 24. This pinching captures flexible container 16 and substantially seals it to housing 12 to prevent the escape of air from flexible container 16 and housing 12 from around opening 24. Flexible container 16 may be removed by first constricting or cinching the opening of flexible container 16 proximally to housing 12. Flexible container 16 may be squeezed by hand to expel excess air prior to complete cinching of the opening. Housing 12 is then rotated upwardly allowing removal of flexible container 16 from interface member 26. Constricting or cinching the opening of flexible container 16 may be performed by any suitable means, as discussed below.

In this manner, mail depository apparatus 10 includes a rigid housing 12 forming a channel 22 adapted for receiving deposited mail items, and an interface member 26 adapted to removeably attach a flexible container 16 to housing 12 for receiving deposited mail items from channel 22. Interface member 26 is adapted to seal flexible container 16 to housing 12 to substantially prevent the escape of air from flexible container 16 and housing 12 around interface member 26. Housing 12 further includes a housing opening 24 forming an exit from channel 22, and interface member 26 includes a peripheral surface 27 adapted for contacting housing 12 around housing opening 24. Interface member 26 is adapted to pinch a peripheral edge 32 of a flexible container opening between peripheral surface 27 and housing 12 around housing opening 24. Interface member is adapted to be fixedly mounted to structural wall 14 and housing 12 is adapted to be movably mounted to structural wall 14 to enable installation of flexible container 16 between housing 12 by movement of housing 12. Interface member 26 includes a rigid ring. Housing 12 is hinged to structural wall 14 along an upper portion of housing 12 and is adapted for upward rotation away from fixedly mounted interface member 26.

Figure 4:
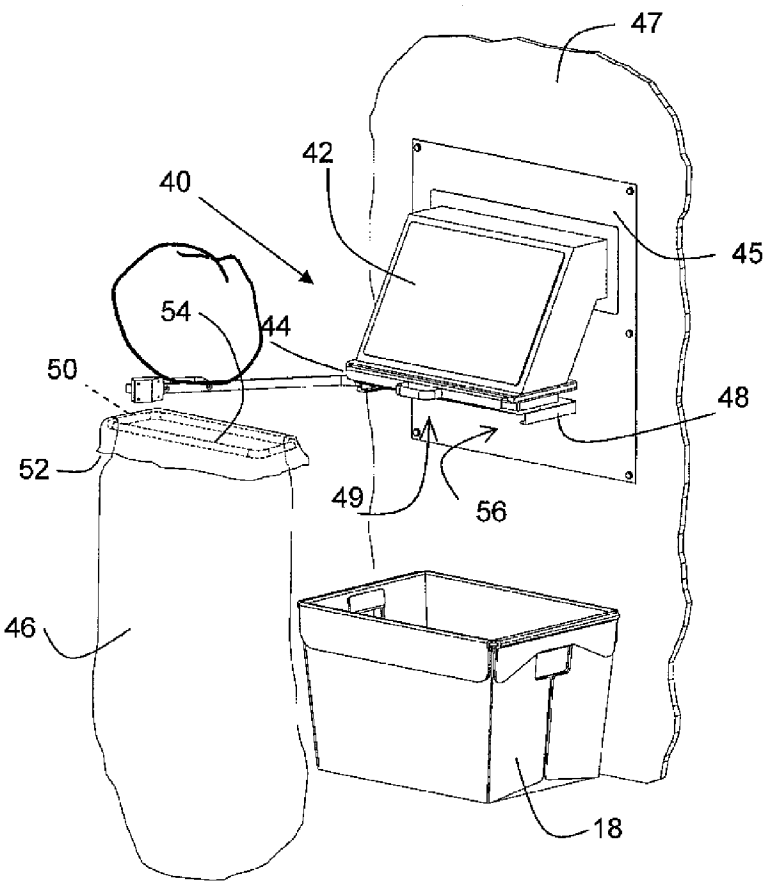
FIG. 4 is a perspective view of another apparatus constructed in accordance with the present invention.

FIG. 4 shows a mail collection apparatus 40 constructed in accordance with another embodiment of the present invention. Apparatus 40 generally includes a housing 42, an interface member 44 and a flexible container 46. Housing 42 defines an inner reception channel (not shown) in the same manner as channel 22 (FIG. 2). Unlike apparatus 10 (FIGS. 1-3), housing 40 is fixedly mounted to a plate 45, which may then be readily mounted to a structure, such as wall 47, and interface member 44 is attached to housing 42.

Interface member 44 includes a collar 48 defining an opening 49 in housing 42 and its respective channel. Interface member 44 also includes a reusable rigid stiffener 50 for connecting flexible container 46 to housing 42 around opening 49. Flexible container 46 includes a peripheral edge 52 around its opening 54, and edge 52 is passed through stiffener 50 and wrapped around stiffener 50 and back on container 46. In this form, stiffener 50 is slid into a groove 56 in collar 48 and a front portion 58 of collar 48 is closed to pinch the edge 52 of opening 54 around the periphery of stiffener 50.

Figure 5:
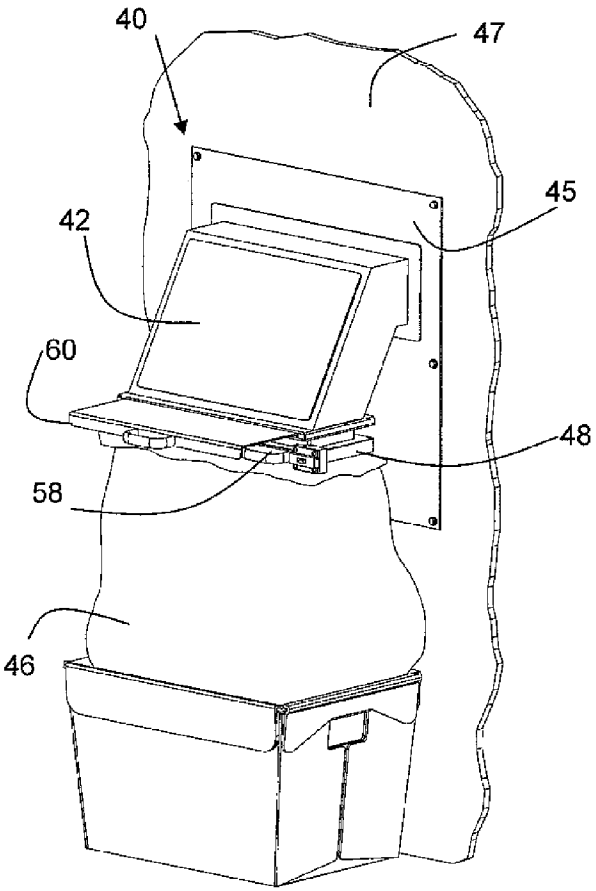
FIG. 5 is another perspective view of the apparatus of FIG. 4.

FIG. 5 shows apparatus 40 having flexible container 46 and stiffener 50 properly installed in collar 48, with front portion 58 in the closed position. FIG. 5 further shows a closure device or shutter 60 which may be slid into housing 42, just above collar 48 to isolate the opening of housing 42 as defined by interface member 44, from flexible container 46.

Figure 6:
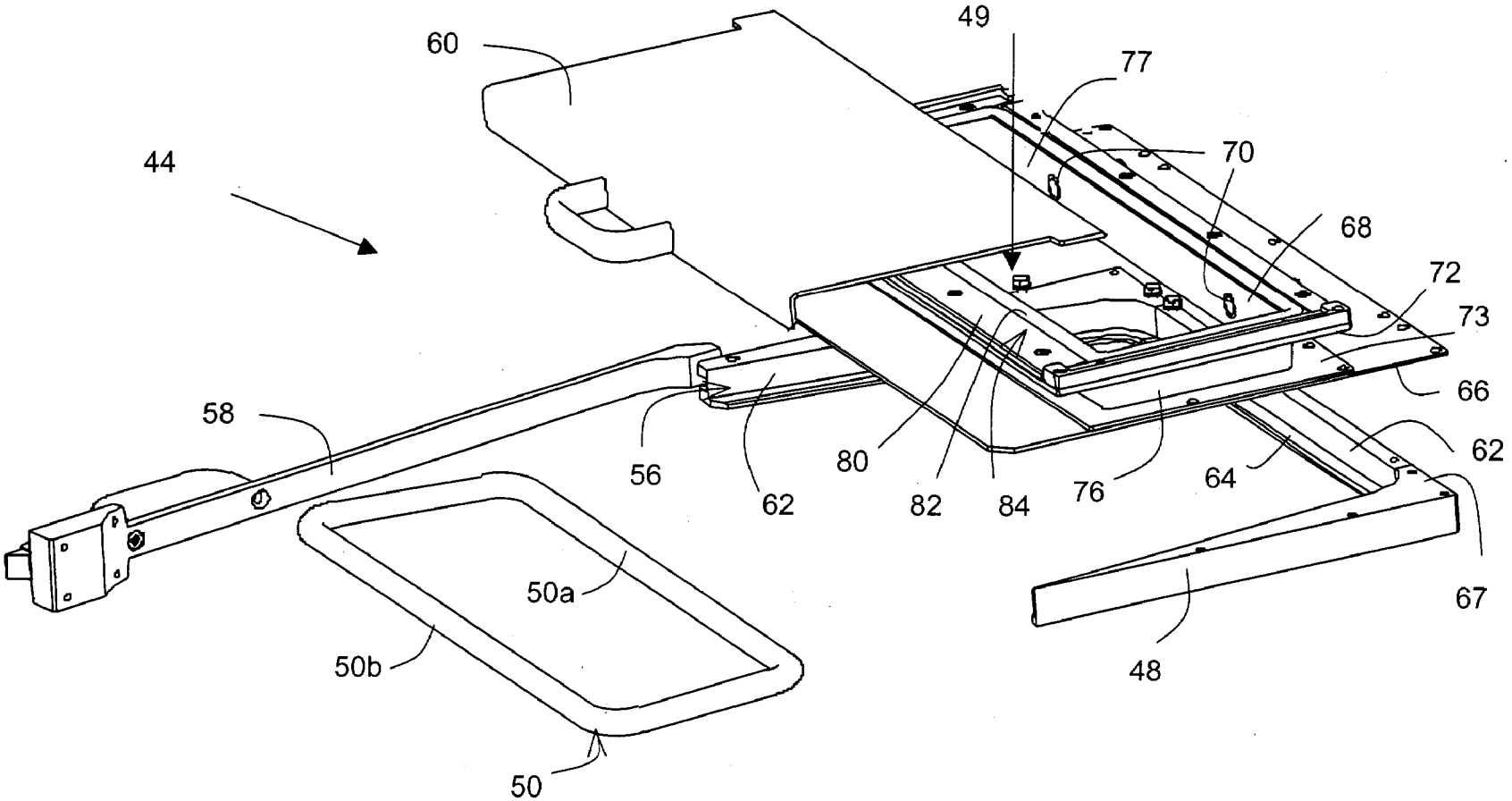
FIG. 6 is a perspective view of yet another apparatus constructed in accordance with the present invention.

FIG. 6 shows a partially exploded perspective view of interface member 44 including stiffening ring 50, collar 48, front portion 58 and shutter 60. Groove 56 is shown partially formed with sides 62 and bottom ledge 64. Groove 56 is completed by the attachment of a plate 66 to the top surface 67 of collar 48, which plate 66 includes a central rectangular opening to maintain housing opening 49.

Affixed to plate 66 is a vent standoff 68, which provides vertical clearance for a pair of conduits or vent holes 70. Vent holes 70 are directed to the right side of FIG. 6 or rear of interface member 44 and thereby away from any personnel using interface member 44. Vent standoff 68 is intended to maintain housing opening 49 to allow deposited mail items to drop there through. For this purpose, vent standoff 68 includes upper and lower horizontal plates 72, 73, respectively, which are connected by a plurality of vertical walls 76, 77. Vertical walls 76, 77 provide vertical clearance for vent holes 70. Although only two vent holes 70 are shown, any suitable number may be used depending upon the vertical size limit for vent standoff 68 and the volume of air expected to be expelled by the compression of flexible container 46 (FIGS. 4-5). Such vent holes may also be widened, depending upon the expected air flow.

Affixed to the top of upper plate 72 of vent standoff 68 is a shutter frame 80 and a shutter seal 82. Shutter frame 80 provides a channel 84 to allow closure device or shutter 60 to slide across a housing opening 49. Shutter seal 82 ensures that shutter 60 substantially seals opening 49 when shutter 60 is fully inserted into frame 80, thereby substantially preventing the escape of air from a flexible container 46 installed with stiffening ring 50 and collar 48 (FIG. 5). Shutter seal 82 nominally includes a lower rigid member affixed to shutter frame 80 and an upper o-ring seal 86.

Stiffening ring 50 is shaped to enable easy installation and pinching of ring 50 and flexible container 46 (FIGS. 4-5) within collar 48. This is accomplished by making the rear side 50*a* of ring 50 shorter than the front side 50*b*. In other words, stiffening ring 50 has a trapezoidal shape wherein front side 50*b* is the longer trapezoidal base. This shape causes pinching of the periphery of ring 50 and flexible container 46 (FIG. 4-5) by the pressing of ring 50 into collar 48. Although a trapezoidal shape is currently used, other shapes may also be used to accomplish the same function.

In this manner, interface member 44 includes a closure device 60 located in proximity to housing opening 49, which closure device 60 is adapted to isolate housing opening 49 from the channel of housing 42. Vent holes 70 are adapted to direct air flow from flexible container 46 (FIG. 5) and away from any personnel engaged in typical closure and removal of flexible container 46. Interface member 44 includes stiffening ring 50, which is adapted to engage a peripheral edge 52 of flexible container opening 54. Interface member 44 further includes collar 48, which is adapted to pinch stiffening ring 50. Collar 48 includes a plurality of sides each having an inwardly facing groove adapted to receive stiffening ring 50. One of the sides 52 is moveable to allow installation and removal of stiffening ring 50 and an associated flexible container 101. Collar 48 includes a plurality of fixed sides. Collar 48 is trapezoidal in shape, and moveable side 52 is longer than each of the fixed sides.

Figure 7:
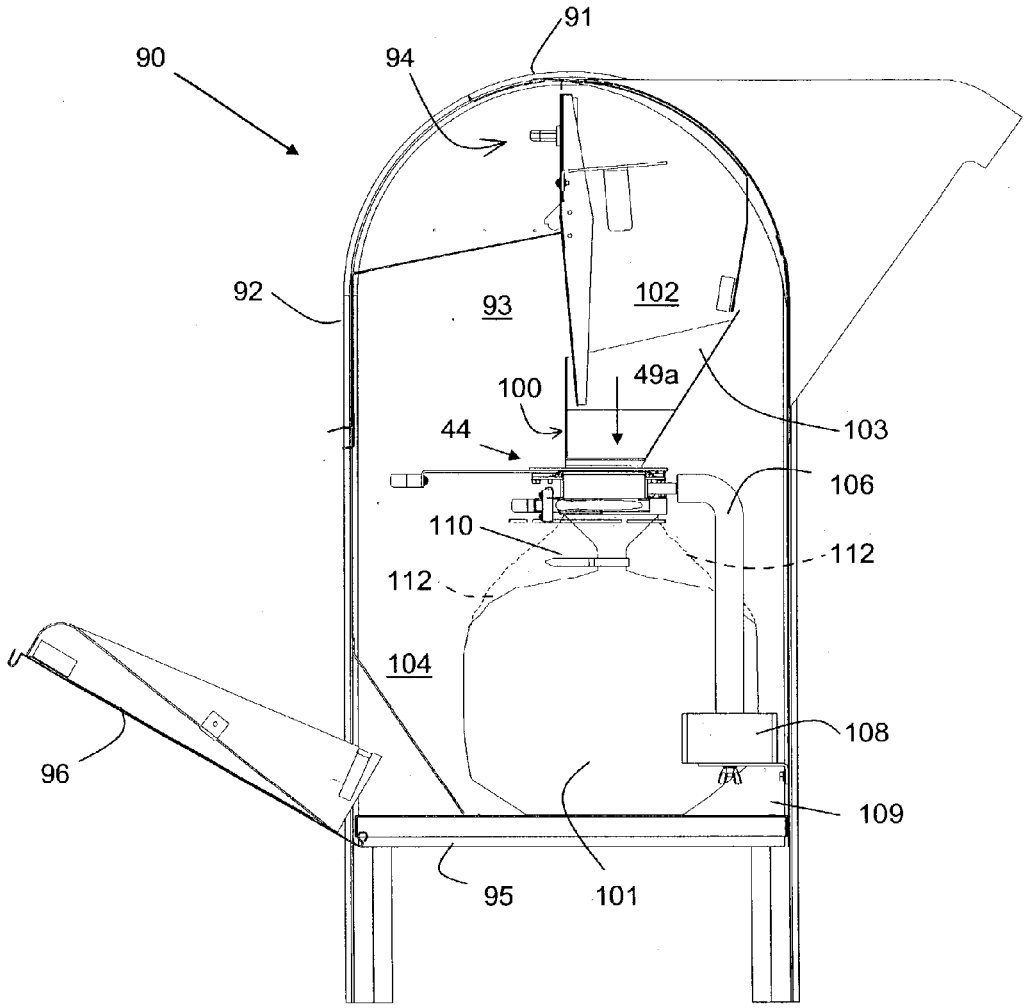
FIG. 7 is a perspective view of still another apparatus constructed in accordance with the present invention.

FIG. 7 shows another embodiment of the present invention as it is used to retrofit currently used mail boxes. For this purpose, apparatus 90 includes a common mail box 92 having a depository port 94 near the upper end 91 of mailbox 92 and a securable service door 96 located near the bottom 95 of mail box 92. Installed within mailbox 92 is a divider 100, which separates the central chamber 93 into a channel or reception chamber 102 operatively associated with depository port 94 and a storage chamber 104 accessible through service door 96. A flexible container 101 is located within storage chamber 102. Divider 100 includes interface member 44 and an upper divider portion 103. Divider 100 and interface member 44 maintain a divider opening 49*a* between reception chamber 102 and storage chamber 104. Interface member 44 seals flexible container 101 around divider opening 49*a* in the same manner as previously described.

FIG. 7 also shows a conduit 106, which is used to direct air flow from the vent holes 70 (FIG. 6) to a HEPA filter 108. Filter 108 is shown to be located in a lower rear corner 109 of mail box 92 and is intended to direct exhaust air from flexible container 46 away from personnel involved in the normal servicing of mail box 92 and removal of flexible container 101. Either conduit 106 or filter 108 may alternatively be vented outside of mail box 92 in a similar rear location. Although only one conduit 106 is shown versus two vent holes 70, any suitable arrangement of conduits may be used for direction exhaust air from flexible container 46. For example, vent holes 70 may each have their own conduit and filter, or vent holes 70 may be coupled together by any suitable arrangement, to direct all of the exhaust air flow through a single conduit and filter.

FIG. 7 shows flexible container 46 as it would appear immediately after constriction or cinching of the flexible container opening by a suitable strap 110. Phantom lines 112 show the normal operative position of flexible container 46 when mailbox 92 is available for depositing mail items.

In this manner, a mail depository apparatus 90 includes a mail box 92 forming a central chamber 93 and having a depository port 94 located in proximity to a top 95 thereof and an access door 96 located in proximity to a bottom 97 thereof. A divider 100 located within central chamber 93 and adapted for separating central chamber 93 into a reception chamber 102 in operable association with depository port 94 and a storage chamber 104 in operable association with access door 96. Divider 100 includes a divider opening 49*a* adapted to allow items deposited into depository port 94 to drop into storage chamber 104. Interface member 44 is adapted to attach a flexible container 101 located in storage chamber 104, to divider opening 49*a* for receiving deposited items from reception chamber 102. Interface member 44 is also adapted to seal flexible container 101 to divider opening 49*a* to substantially prevent escape of air from flexible container 101 and reception chamber 102 at interface member 44. Divider 100 includes a closure device 60 located in proximity to divider opening 49*a*, which is adapted to isolate divider opening 49*a* from reception chamber 102. A vent conduit 70 is adapted to direct air flow from flexible container 101 and through divider opening 49*a*, wherein vent conduit 49*a* is routed to a remote location 109 away from any personnel engaged in typical closure and removal of flexible container 101. A filter device 108 is coupled to vent conduit 70 and adapted for filtering air flow directed from flexible container 101.

Each of apparatus 10 (FIGS. 1-3), apparatus 40 (FIGS. 4-5) and mail depository apparatus 90 (FIG. 7), includes a flexible container 16, 46, 101, respectively having a single opening adapted to be substantially sealed to housing 12, 42, and divider 100, respectively, by an interface member 26, 44, 44, respectively. In each of those cases, a cinching strap peripherally located around the flexible container in proximity to the single opening may be adapted to constrict the flexible container and close it while the flexible container is sealed by the respective interface member, in the same manner demonstrated in FIG. 6. Any suitable non-porous material may be used for the flexible containers, such as low linear density polyethylene with a thickness of two to three mils.

Figure 8:
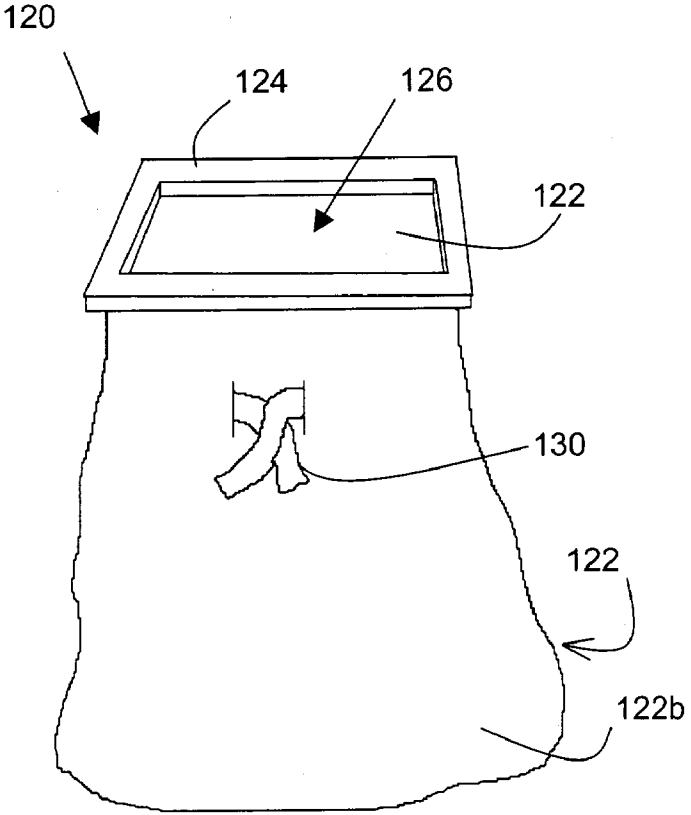
FIG. 8 is a perspective view of a flexible container suitable for use in the present invention.

FIG. 8 is a perspective view of a flexible container 120 suitable for use with the embodiments of FIGS. 4-7. Flexible container 120 generally includes flexible bag portion 122 and a stiffening ring 124. Stiffening ring 124 is generally trapezoidal in shape, like stiffening ring 50 (FIG. 6), and is sealed to the periphery of the opening 126 of flexible bag portion 122. Stiffening ring 124 may be made from any suitable material such as cardboard or plastic, which is capable of maintaining stiffness in the two dimensions defined by the imaginary plane of opening 126 and represented by stiffening ring 124. In this form, flexible container 120 may be installed in any suitable apparatus, such as collar 48 of FIG. 6, wherein stiffening member 124 is located within groove 56 and movable side 58 presses on stiffening ring 124 to cause the outer peripheral edge 128 of stiffening ring 124 to be pinched within groove 56. The planar nature of stiffening ring 124 allows unused containers 120 to be stored flat. Stiffening ring 124 ay be any suitable shape, besides trapezoidal, which allows the entire periphery thereof to be contacted and pressured by pressing the ring into an appropriate collar.

Flexible container 120 further includes a cinching strap 130 which is embedded between a plurality of layers of flexible bag 122 and is shown with its ends extending from between this plurality of layers. The plurality of layers are represented by the inner surface 122*a* and outer surface 122*b* of bag 122. Cinching strap 130 is located at a sufficient distance from stiffening ring 124 to allow flexible bag 122 to be cinched closed without being detached from stiffening ring 124. Of course, the use of flexible container 120 in the interface member 44 (FIG. 6) would be in place of stiffening ring 50.

In this manner, a flexible container 120 for receiving deposited mail items includes a flexible bag 122 having an opening 126 sized to fit around a rigid collar 48 (FIG. 6) and a stiffening ring 124 adapted to engage flexible bag 122 around opening 126 and to facilitate sealing flexible bag 122 to collar 48 (FIG. 6). Flexible bag 122 is adapted to be cinched closed in proximity to stiffening ring 124 while flexible bag 122 is fitted to collar 48 (FIG. 6).

Flexible bag 122 may include a plurality of layers 122*a*, 122*b* forming at least a portion of bag 122 and a cinch strap 130 may be at least partially enclosed between the plurality of layers 122*a*, 122*b*. Stiffening ring 124 may be sealed to opening 126. Stiffening ring 124 may be adapted to be sealed to collar 48 (FIG. 6). Stiffening ring 124 may be stiff in two orthogonal dimensions parallel to an imaginary plane formed by the opening 126 and represented by ring 124.

Figure 9:
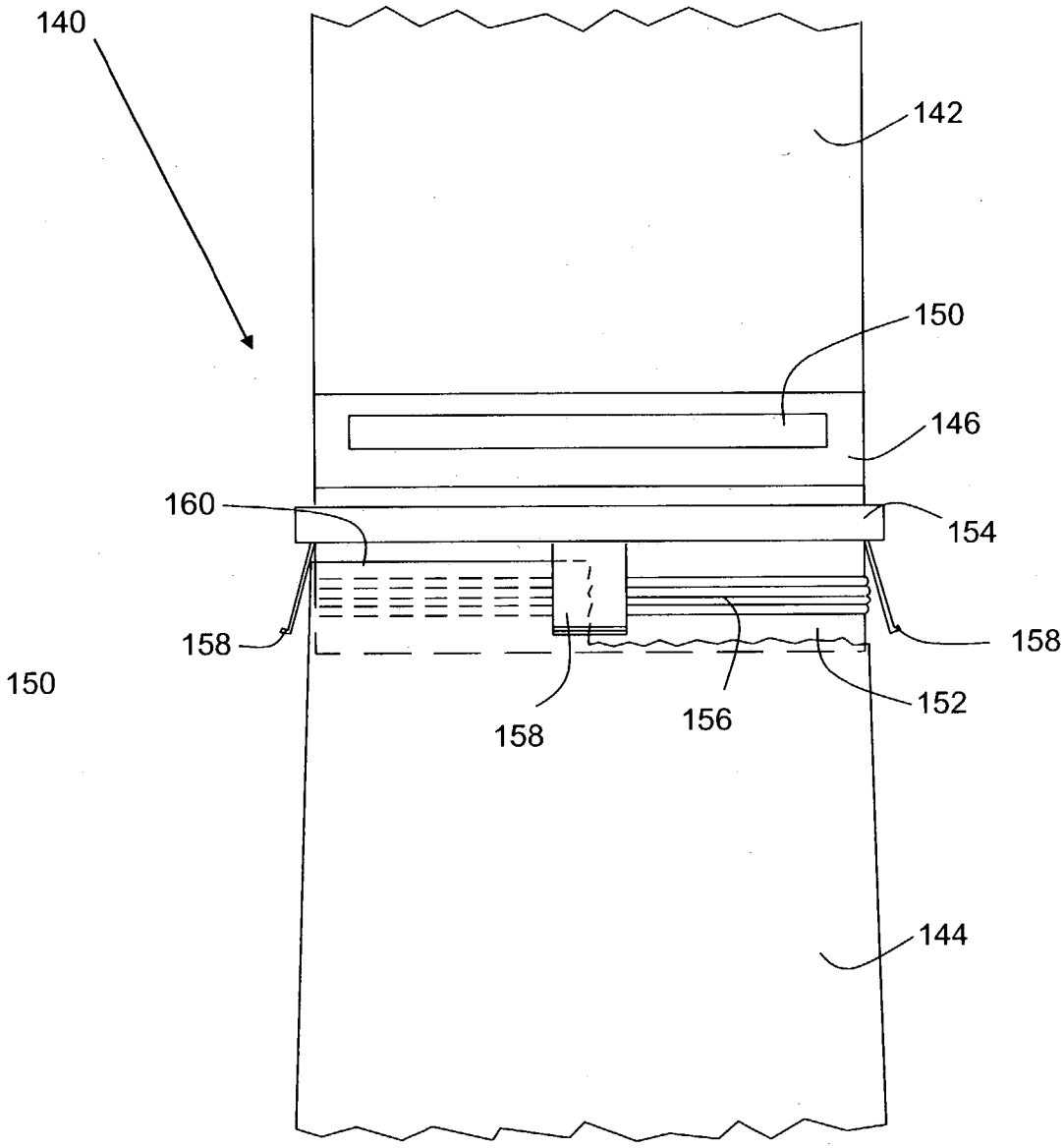
FIG. 9 is a side view of an apparatus constructed in accordance with another embodiment of the present invention.

FIG. 9 shows a side view of an alternate interface member 140, which may be used in conjunction with a housing 142 and a flexible container 144 in accordance with the present invention. Interface member 140 generally includes an upper portion 146 and a lower portion or collar 148. Upper proportion 146 includes a slot 150 suitable for use with a closure device such as shutter 60 (FIG. 5). Collar 148 generally includes a fixed inner collar 152 and a movable outer collar 154, which are adapted to capture flexible container 144 there between. Inner collar 152 may include an area of higher friction 156 which may also function to form a seal with flexible container 144. Friction band 156 may be made of any suitable material such as rubber, and may also be compressible to aid in forming a seal with flexible container 144.

Collar 148 further includes a plurality of flaps 158 which are adapted to press the peripheral edge 160 of container 144 against inner collar 152. In practice, collar 154 is raised to the position shown while flexible container 144 is located around inner collar 152 and beneath flaps 158. In this position slight pressure from flaps 158 is used to temporarily maintain peripheral edge 160 against friction band 156. Outer collar 148 is moved downwardly to exert additional pressure against flaps 158 and container 144 thereby pressing the peripheral edge 160 more tightly against friction band 156. Peripheral edge 160 is sized to fit firmly around the inner collar 152 and may include an elastic function to help retain its position around collar 152.

Figure 10:
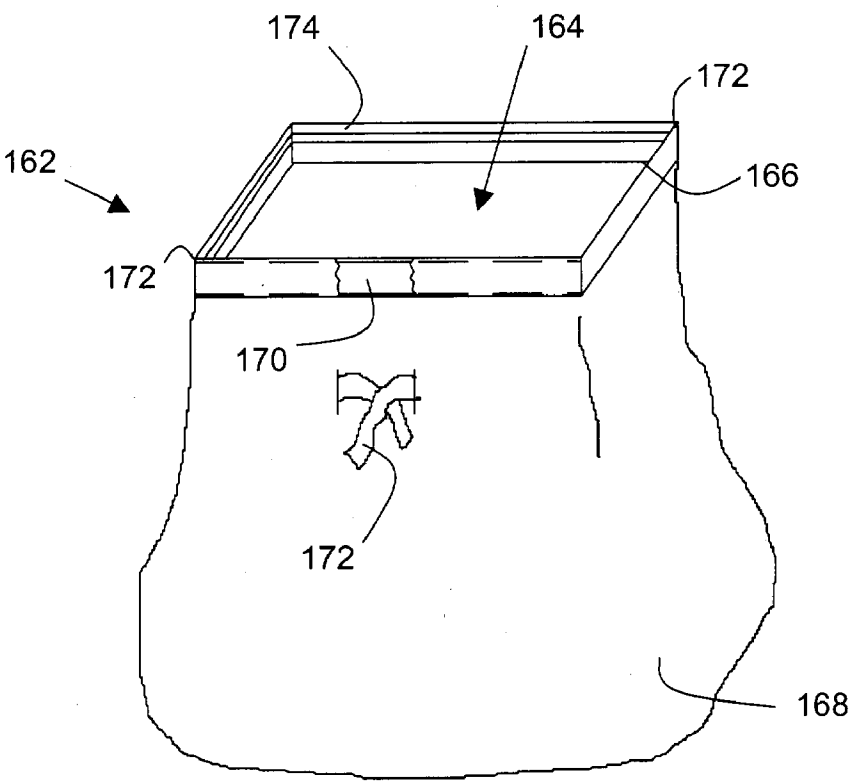
FIG. 10 is a perspective view of a flexible container suitable for use in the present invention.

FIG. 10 shows a perspective view of a flexible container 162 which may be used for purposes of the present invention. Flexible container 162 generally includes a flexible bag 168 having a single opening 164 surrounded by a peripheral edge 166, which opening 164 and peripheral edge 166 may define an imaginary plane in the same manner as opening 126 (FIG. 8) defines an imaginary plane represented by stiffening ring 124 (FIG. 8). Embedded within peripheral edge 166 of flexible container 162 is a stiffener or stiffening ring 170, which provides stiffness to peripheral edge 166 in the dimension perpendicular to the imaginary plane formed by peripheral edge 166 and flexible container opening 164. Stiffening ring 170 is formed from an elongated piece of flat material such as cardboard or plastic, and is folded at corners 172 of peripheral edge 166 to form a ring around peripheral edge 166. In this manner, peripheral edge 166 is provided with sufficient stiffness to allow convenient application to a housing port or interface member such as 140 (FIG. 9), while still allowing flexible container 162 to be easily folded flat for storage.

Flexible container 162 further includes a cinching strap 172 embedded between multiple layers of bag 168 in the same manner as flexible bag 122 (FIG. 8). Flexible container 162 may further include an adhesive strip 174 located around the inside of peripheral edge 166 to aid attachment and sealing of flexible container 162 to a suitable interface member.

In this manner, a flexible container 162 for receiving deposited mail items includes a flexible bag 168 having an opening 164 sized to fit around a rigid collar 152 (FIG. 9) and a stiffening ring 170 adapted to engage flexible bag 168 around opening 164 and to facilitate sealing flexible bag 168 to collar 152. Flexible bag 168 is adapted to be cinched closed in proximity to stiffening ring 170 while flexible bag 168 is fitted to collar 152. Stiffening ring 170 may be stiff in a dimension perpendicular to an imaginary plane formed by opening 164. The container 162 may include an adhesive strip 174 located around opening 164 to facilitate sealing opening 164 to collar 152.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A mail depository apparatus, comprising:

a rigid housing forming a chamber adapted for directing deposited mail items;

said housing including a housing opening, forming an exit from said chamber for deposited mail items, and a closure device located in proximity to said housing opening and adapted to isolate said housing opening from said chamber;

a flexible container;

an interface member adapted to attach said flexible container to said housing around said housing opening for receiving deposited mail items from said chamber;

wherein said interface member is adapted to seal said flexible container to said housing to substantially prevent escape of air from said flexible container and said housing at said interface member; and wherein said interface member includes a peripheral surface adapted for contacting said housing around said housing opening, and wherein said interface member is adapted to pinch a peripheral edge of an opening of the flexible container between said peripheral surface and said housing around said housing opening.

2. The apparatus of claim 1, wherein said interface member includes a stiffening ring adapted to engage the peripheral edge of the opening of the flexible container.

3. The apparatus of claim 2, wherein said stiffening ring is sealed to said peripheral edge of said flexible container opening.

4. The apparatus of claim 2, wherein said stiffening ring is only stiff in a dimension perpendicular to an imaginary plane defined by said flexible container opening.

5. A mail depository apparatus, comprising:

a rigid housing forming a chamber adapted for directing deposited mail items;

said housing includes a housing opening forming an exit from said chamber for deposited mail items;

a flexible container;

an interface member adapted to attach said flexible container to said housing around said housing opening for receiving deposited mail items from said chamber;

wherein said interface member is further adapted to seal said flexible container to said housing to substantially prevent escape of air from said flexible container and said housing at said interface member;

wherein said interface member includes a peripheral surface adapted for contacting said housing around said housing opening;

wherein said interface member is further adapted to pinch a peripheral edge of an opening of the flexible container between said peripheral surface and said housing around said housing opening; and wherein said interface member is adapted to be fixedly mounted to a structure, and further wherein said housing is adapted to be movably mounted to said structure to enable installation of the flexible container between said interface member and said housing by movement of said housing.

6. The apparatus of claim 5, wherein said interface member comprises a rigid ring.

7. A mail depository apparatus, comprising:

a rigid housing forming a chamber adapted for directing deposited mail items;

said housing includes a housing opening forming an exit from said chamber for deposited mail items;

an interface member adapted to attach a flexible container to said housing around said housing opening for receiving deposited mail items from said chamber;

wherein said interface member is further adapted to seal said flexible container to said housing to substantially prevent escape of air from said flexible container and said housing at said interface member;

wherein said interface member includes a peripheral surface adapted for contacting said housing around said housing opening;

wherein said interface member is further adapted to pinch a peripheral edge of an opening of the flexible container between said peripheral surface and said housing around said housing opening; and wherein said interface member is adapted to be fixedly mounted to a structure, and further wherein said housing is adapted to be movably mounted to said structure to enable installation of the flexible container between said interface member and said housing by movement of said housing, wherein said housing is hinged to said structure along an upper portion of said housing and adapted for upward rotation away from said fixedly mounted interface member.

8. The apparatus of claim 7, wherein said structure is a wall and said chamber is adapted for access through an opening in said wall.

9. A mail depository apparatus, comprising:

a rigid housing forming a channel adapted for directing deposited mail items;

a flexible container; and an interface member adapted to attach said flexible container to said housing for receiving deposited mail items from said channel, wherein said interface member is adapted to seal said flexible container to said housing to substantially prevent escape of air from said flexible container and said housing at said interface member, said interface member including a stiffening ring adapted to engage a peripheral edge of an opening of the flexible container, and wherein said interface member further comprises a collar adapted to pinch said stiffening ring and an engaged said peripheral edge.

10. A mail depository apparatus, comprising:

a rigid housing forming a channel adapted for directing deposited mail items; and an interface member adapted to attach a flexible container to said housing for receiving deposited mail items from said channel, wherein said interface member is adapted to seal said flexible container to said housing to substantially prevent escape of air from said flexible container and said housing at said interface member, said interface member including a stiffening ring adapted to engage a peripheral edge of an opening of the flexible container, and wherein said interface member further comprises a collar adapted to pinch said stiffening ring and an engaged said peripheral edge, wherein said collar comprises a plurality of sides each having an inwardly facing channel adapted to receive said stiffening ring.

11. The apparatus of claim 10, wherein one of said sides is moveable to allow installation and removal from said collar of said stiffening ring and the flexible container.

12. The apparatus of claim 11, wherein said collar is adapted to squeeze a periphery of said stiffening ring when said ring is pressed into said collar by said one moveable side.

13. The apparatus of claim 12, wherein said collar is trapezoidal in shape, and further wherein said moveable side is longer than each of the remaining said sides which are fixed sides.

14. A mail depository apparatus, comprising:

a rigid housing forming a channel adapted for directing deposited mail items;

an interface member being adapted to attach a flexible container to said housing for receiving deposited mail items from said channel, said interface member being adapted to seal said flexible container to said housing to substantially prevent escape of air from said flexible container and said housing at said interface member;

said flexible container having a single opening adapted to be substantially sealed to said housing by said interface member; and a cinching strap peripherally located around said flexible container in proximity to said single opening and adapted to constrict said flexible container and close said flexible container while said flexible container is sealed to said housing.

15. A method for collecting mail items in a flexible container, comprising the steps of:

orienting a channel for directing deposited mail items to drop through a channel opening;

sealing said flexible container around said channel opening with an interface member to contain mail items and to prevent escape of air from said flexible container and said channel at said interface member;

closing said channel opening with a closure member to isolate said channel from said flexible container, and cinching said flexible container substantially closed with a cinch member in proximity to said channel opening while said flexible container is sealed around said channel opening.

16. A method for collecting mail items in a flexible container, comprising the steps of:

orienting a channel for directing deposited mail items to drop through a channel opening;

sealing said flexible container around said channel opening with an interface member to contain mail items and to prevent escape of air from said flexible container and said channel at said interface member; and closing said channel opening with a closure member to isolate said channel from said flexible container, wherein said step of sealing includes pinching a peripheral edge of an opening of said flexible container between said interface member and a housing forming at least a portion of said channel.

17. A flexible container for receiving deposited mail items, comprising:

a flexible bag having an opening sized to fit around a rigid collar, said bag including a plurality of layers forming at least a portion of said bag;

a cinch strap at least partially enclosed between said plurality of layers; and a stiffening ring adapted to engage said bag around said opening and to facilitate sealing said flexible bag to the collar;

said flexible bag being adapted to be cinched closed in proximity to said stiffening ring while said bag is fitted to the collar, by said cinch strap being located a distance from said opening of said flexible bag.

18. The flexible container of claim 17, wherein said stiffening ring is sealed to said flexible bag at said opening.

19. The flexible container of claim 17, wherein said stiffening ring is adapted to be sealed to the collar.

20. The flexible container of claim 19, wherein said ring is stiff in two orthogonal dimensions parallel to an imaginary plane formed by said opening.

21. The flexible container of claim 19, wherein said ring is stiff in a dimension perpendicular to an imaginary plane formed by said opening.

22. A mail depository apparatus, comprising:

a rigid housing forming a chamber adapted for directing deposited mail items;

said housing including a housing opening forming an exit from said chamber for deposited mail items;

a flexible container;

an interface member adapted to attach the flexible container to said housing around said housing opening for receiving deposited mail items from said chamber;

wherein said interface member includes a peripheral surface and is further adapted to pinch a peripheral edge of an opening of the flexible container between said peripheral surface and said housing around said housing opening; and wherein said interface member is adapted to be fixedly mounted to a structure, and further wherein said housing is adapted to be movably mounted to said structure to enable installation of the flexible container between said interface member and said housing by movement of said housing.

23. The apparatus of claim 22, wherein said peripheral surface is adapted for contacting said housing around said housing opening.

24. The apparatus of claim 22, wherein said interface member comprises a rigid ring.

25. A mail depository apparatus, comprising:

a rigid housing forming a chamber adapted for directing deposited mail items;

said housing including a housing opening forming an exit from said chamber for deposited mail items;

an interface member adapted to attach a flexible container to said housing around said housing opening for receiving deposited mail items from said chamber;

wherein said interface member includes a peripheral surface and is further adapted to pinch a peripheral edge of an opening of a flexible container between said peripheral surface and said housing around said housing opening; and wherein said interface member is adapted to be fixedly mounted to a structure, and further wherein said housing is adapted to be movably mounted to said structure to enable installation of the flexible container between said interface member and said housing by movement of said housing wherein said interface member comprises a rigid ring, wherein said housing is hinged to said structure along an upper portion of said housing and adapted for upward rotation away from said fixedly mounted interface member.

* * * * *